United States Patent [19]

Dawson et al.

[11] 4,006,878

[45] Feb. 8, 1977

[54] CONCRETE FORM ASSEMBLY

[75] Inventors: Robert H. Dawson, Lake Bluff; James L. McGrath, Medinah, both of Ill.

[73] Assignee: Reliable Electric Company, Franklin Park, Ill.

[22] Filed: July 16, 1973

[21] Appl. No.: 379,791

[52] U.S. Cl. ..... 249/43; 249/46; 249/213; 249/217

[51] Int. Cl.[2] ..... E04G 11/08; E04G 17/08

[58] Field of Search ..... 52/223 L; 425/111; 249/43, 46, 190–191, 213, 216–217, 219 W, 214; 264/228–229; 57/140 G

[56] References Cited

UNITED STATES PATENTS

| | | | |
|---|---|---|---|
| 1,716,872 | 6/1929 | Williams | 425/111 |
| 2,160,489 | 5/1939 | Spies | 249/43 |
| 2,573,361 | 9/1951 | Rodgers, Jr. et al. | 57/140 G |
| 3,049,775 | 8/1962 | Ondeck | 425/111 |
| 3,163,904 | 1/1965 | Ziolkowski | 425/111 |
| 3,399,437 | 10/1968 | Kelly | 425/111 |
| 3,524,228 | 8/1970 | Kelly | 425/111 |
| 3,577,613 | 5/1971 | Hidden | 425/111 |
| 3,734,453 | 5/1973 | Bailey | 249/213 |

*Primary Examiner*—Francis S. Husar
*Assistant Examiner*—John McQuade
*Attorney, Agent, or Firm*—Olson, Trexler, Wolters, Bushnell & Fosse Ltd.

[57] ABSTRACT

A concrete form assembly comprises spaced apart form members that are retained in position during concrete pouring by an arrangement that includes spacer elements, plastic tie rods, and anchors. The anchors are on the outsides of the forms and grip the tie rods. Each anchor comprises a tapered jaw cluster in a tapered shell so arranged that outward forces applied to the forms due to concrete being poured therebetween increases the grip of the anchors on the tie rods to retain the forms at the established spacing.

5 Claims, 6 Drawing Figures

Fig. 1
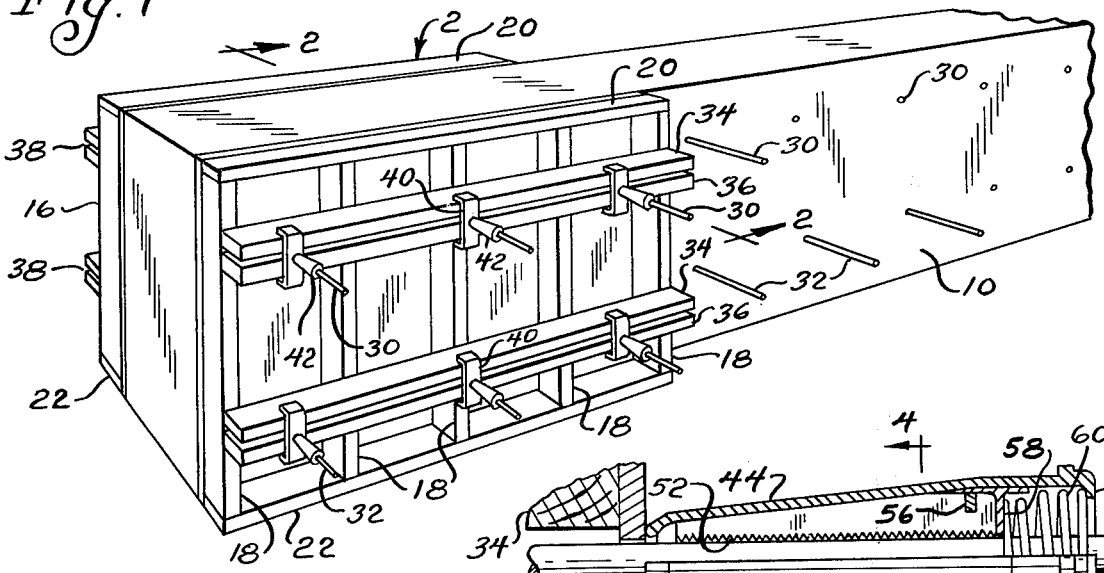
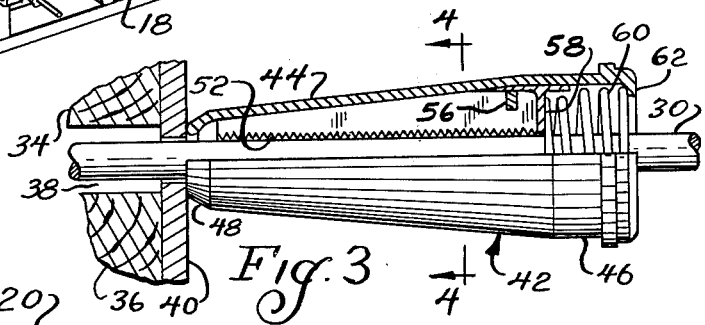
Fig. 3
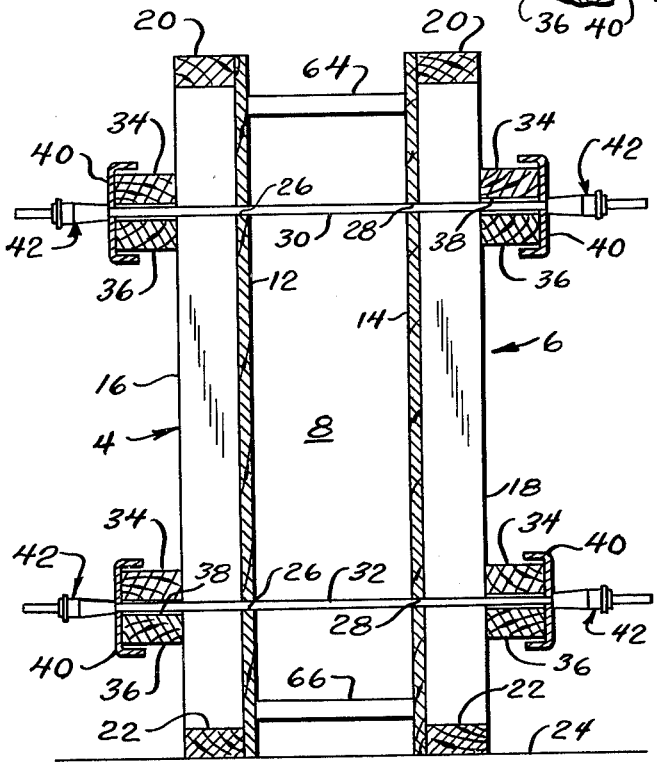
Fig. 2
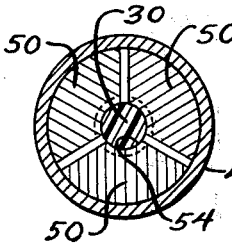
Fig. 4
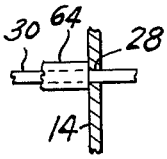
Fig. 6
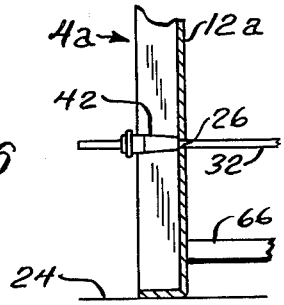
Fig. 5

CONCRETE FORM ASSEMBLY

BACKGROUND OF THE INVENTION

This invention relates to improvements in form assemblies used for pouring concrete.

In the erection of forms for pouring concrete walls and other structures, various arrangements are used to maintain the forms a fixed distance apart. One such arrangement has involved the use of steel ties that run between the forms and which are clamped in a suitable manner on the outsides of the forms. When the concrete is poured, the steel tie is encased in the concrete and a portion of the steel tie at each end extends beyond the conrete at each side thereof. These extended parts of the ties may be cut off flush with the surface of the concrete, but this still leaves the end surfaces of the ties exposed.

Where the concrete constitutes a part of the architectural scheme of the structure, the surface quality of the concrete is critical from an appearance point of view. Therefore, where steel ties have been used, problems have been created due to rust blemishes in the regions of the ties. Of course, the end surfaces of the ties can be grouted over where they are cut off, but this is not always satisfactory unless special provision is made to recess the concrete at the tie ends. In addition such procedure involves further costs.

OBJECTS AND SUMMARY OF THE INVENTION

An object of this invention is to provide a concrete form assembly which utilizes a plastic tie between the forms so that in the completed concrete structure rust blemishes due to form ties will be avoided.

A further object of this invention is to provide an assembly of the type stated which embodies anchors on the outsides of the forms for gripping the plastic tie rods, the anchors being such that increased gripping pressure will be applied to the tie by the anchors as the amount of concrete increases in the form during the pouring operation.

Another object of this invention is to provide an anchor for the purpose stated which is readily adjustable on the tie rod so as to accommodate a wide range of form spacing. The anchor comprises a tapered casing or shell that has a tapered jaw cluster for gripping the tie whereby the grip of the jaw cluster on the tie rod is automatically effected and maintained when the anchor is properly mounted in place.

In accordance with the foregoing objects the form assembly of the present invention comprises spaced apart form members with spacer elements spanning the space between the form members and establishing a preselected distance between the form members. The form members have holes therein positioned such that there are a number of pairs of aligned holes in the respective forms for receiving a number of parallel plastic tie rods. These tie rods span the space between the form members and project through their associated holes in the form members so as to extend outwardly of the mold cavity defined by the forms. An anchor member is mounted on the outside of each form member over the outwardly extended part of each tie rod. The anchor member includes a tapered shell having a smaller end presented toward the adjacent form. Within each shell are arcuate, tapered jaws that are longitudinally juxtaposed to define a tapered jaw cluster with a bore that receives the plastic tie rod. The jaws have teeth presented to the bore for gripping the plastic tie rod. Furthermore, each shell has a spring that urges the jaw cluster toward the adjacent form and into gripping engagement with the tie rod such that forces tending to move the forms further apart during pouring of the concrete will act on the anchor shells at their respective smaller ends to increase the grips on the rods and thereby maintain the preselected or established distance between the forms. In a preferred form of the invention the rods are made of glass fibers due to the fact that this material has excellent physical properties, particularly as to tensile strength, and is inherently inert to the concrete, moisture, and most ambient corrosive elements.

BRIEF DESCRIPTION OF THE FIGS.

FIG. 1 is a partial perspective view of a concrete form assembly constructed in accordance with and embodying the present invention, and showing poured concrete in place between the forms;

FIG. 2 is a sectional view, on an enlarged scale, taken along line 2—2 of FIG. 1 but showing the forms prior to pouring of the concrete therebetween;

FIG. 3 is an enlarged partial sectional view of the structure of FIG. 2 in the region of one of the anchors;

FIG. 4 is a sectional view taken along line 4—4 of FIG. 3; and

FIG. 5 is a fragmentary sectional view showing a different type of form assembly in accordance with the present invention.

FIG. 6 is a fragmentary sectional view of a form assembly in which a tie rod is within a spacer.

DETAILED DESCRIPTION

Referring now in more detail to the drawing, which illustrates a preferred embodiment of the present invention, there is shown, by way of example, a concrete form assembly 2, comprising form members 4, 6. The form members 4, 6 may take such shape as may be required to provide a cavity 8 therebetween and into which the concrete 10 is poured.

In the embodiment of the invention herein shown, the forms 4, 6, include upstanding plywood panels, 12, 14 that define the surfaces of the cavity 8. The panels 12, 14 are rigidified and reinforced by upstanding braces 16, 18 which are joined by upper and lower horizontal braces 20, 22. The lower braces 22 may rest on a supporting surface 24, which may be at grade level, below grade level, or otherwise. The braces may be of convention stud lumber.

The panels 12, 14 are formed with holes 26, 28 there being a suitable number of such holes depending upon the lengths of the forms 4, 6. In any event, each hole 26 in the panel 12 is aligned with a hole 28 in the panel 14. These holes 26, 48 are sized for slidably receiving upper and lower tie rods 30, 32. As seen in FIG. 1, there are a number of upper and lower tie rods 30, 32 spaced along the length of each of the forms, and the number of tie rods will, of course, depend upon the overall lengths of the forms. Furthermore, while an upper and a lower row of tie rods are herein shown, it will be apparent that additional rows of tie rods may be provided in accordance with the overall height of each form.

Nailed or otherwise secured to the vertical braces 16, 18 are pairs of horizontally extending cross bars 34, 36. Each pair of cross bars 34, 36 has a gap 38 therebetween and through which the extended ends of the tie rods 30, 32 loosely project. The gaps 38 are, therefore, in alignment with the holes 26, 28. These cross bars 34, 36 may also be of stud lumber and not only serve to further rigidify the forms 4, 6 but also are adapted to receive U-shaped metal brackets 40. These brackets 40 are apertured at their bights for receiving the tie rods 30 or 32, as the case may be.

Mounted on the rods 30, 32 outwardly of the brackets 40 are gripping devices or anchors 42. As best seen in FIGS. 3 and 4 each anchor comprises a metallic casing or shell 44 which is internally and externally tapered from the region of its larger end 46 toward its smaller end 48. When the anchor 40 is mounted on the tie rod, the smaller end 48 will abut the bracket 40. Within the shell 44 is an externally tapered jaw cluster that is formed by a number of arcuate jaws 50, 50, 50, that are longitudinally juxtaposed and are provided with teeth 52. The jaw cluster and in particular the teeth 52 thereof define a generally circular bore 54 running coaxially with the bore of the shell 44. The jaws 50, 50, 50 are held together at their larger ends by an annular resilient washer 56, the jaws being peripherally grooved to receive the washer 56. At the larger ends of the jaws, there is a cup 58 that cooperates with a preloaded coil spring 60 to urge the jaws toward the smaller shell end 48 and hence into gripping engagement with the tie rod. The larger end 46 of the shell is turned inwardly to provide a flange 62 that may be formed after assembly of the anchor components. The flange 62 serves to retain the components within the shell 44.

In use the forms 4, 6, are set up with the desired spacing between the panels 12, 14. If desired, the forms 4, 6 may be temporarily held or braced in any conventional manner as by nailing pieces of lumber between opposed braces 20, 20 at spaced regions along the forms. Upper and lower spacers 64, 66 are placed between the panels 12, 14 and are held frictionally in place. While only two spacers are shown in FIG. 2 it will be apparent that there are a number of upper spacers that are parallel to the spacer 64 shown depending upon the lengths of the forms. A like situation applies with respect to the lower spacer 66. In addition, spacers 64, 66 may be of a tubular plastic or other lightweight material that is inert to the concrete. The spacers are cut to lengths for each set up of a pair of forms so as to establish the desired form spacing.

The tie rods 30, 32 may then be inserted through the brackets 40 on one side of the form assembly and into the gaps 38 associated therewith. The rods are then pushed through the holes 26, 28 and out through the brackets 40 and gaps 38 on the opposite form. If the spacers 64, 66 are aligned with pairs of the holes 26, 28, the rods 30, 32 may be inserted through the spacers. See FIG. 6 showing tie rod 30 within spacer 64. The anchors 42 may then be mounted on the ends of the rods 30, 32 and shifted along the rods until the smaller ends 48 of the respective shells 44 abut the associated brackets 40 as appurtenant portions of the form panels. The temporary bracing previously referred to may then be removed. Thereafter, if desired, the ends of the rods outwardly of the anchors may be grasped and the anchors pushed firmly against the brackets 40 to place the rods 30, 32 in tension. This provides a rigid assembly of the forms, the spacers, the tie rods, and the anchors. The tensioning of the tie rods 30, 32, as aforesaid, may be done with tools known in the construction art.

The spacers 64, 66 are of sufficient rigidity to prevent buckling when the tie rods are tensioned. Where the forms 4, 6 are widely spaced, inserting the tie rods through the spacers can aid in preventing buckling of the spacers under compression even where the spacers are of relatively thin wall tubing.

When concrete is poured between the forms 4, 6 the force of the concrete tends to move the panels 12, 14 apart. However, these forces are exerted on the brackets 40 which in turn, exert forces against the smaller ends 48 of the anchors 42. This urges the jaws together and causes the teeth 52 to bite more firmly into the tie rods and thereby resist separation of the forms. When the concrete has cured sufficiently to permit removal of the forms, the anchors may be grasped to snap off the rods 30, 32 at or adjacent to the brackets 40 with the ends 48 of the anchors bearing thereon as fulcrums. In the right hand portion of FIG. 1, the forms are partially removed and the tie rod ends have been snapped off. In a typical situation the rods are of glass fibers and are of a diameter of about 0.25 inches. Hence, it is easy to break the rods manually. After the forms have been removed, the end portions of the tie rods that remain can be removed with a disc sander or cutting torch whereby the ends of the tie rods are flush with the surfaces of the concrete. The scrap tie rod ends can be removed from the anchors and the anchors can be used again.

In a modification of the invention shown in FIG. 5 the form 4*a*, as well as its companion form of like construction, is of metal but otherwise functions the same as the forms 4, 6 previously described. Where metal forms are used, it may be unnecessary to use the cross bars 34, 36 and the brackets 40 since the smaller end of the anchor 42 can abut directly against the outside surface as an appurtenant surface portion of the vertical panel 12*a* of the form 4*a*.

The invention is claimed as follows:

1. A concrete form assembly comprising spaced apart forms, spacers spanning the space between said forms and establishing a preselected distance therebetween, said forms having holes positioned such that holes in one form are aligned with holes in the other form, plastic tie rods spanning the space between said forms and projecting through pairs of said aligned holes, and anchors on the outsides of said forms and receiving said rods, said anchors each including a tapered shell having a smaller end presented toward the adjacent form and abutting an appurtenant portion thereof; a plurality of arcuate tapered jaws in each shell that are longitudinally juxtaposed to define a tapered jaw cluster with a bore that receives the rods, said jaws having teeth presented to said bore for gripping the rod, each of said shells having spring means therein that urges said jaw cluster therein toward the adjacent form and into gripping engagement with the rod such that forces tending to move the forms further apart upon pouring concrete between said forms act on said shells at the respective smaller ends thereof to increase the grip on said rod by said jaw teeth and thereby maintain said preselected distance despite said forces, said tie rods being of such size, crosssection and composition as to be manually breakable, and said anchors being exposed for manual gripping and movement with the smaller ends thereof fulcruming on the appurtenant portions of the forms to break off the tie rods adjacent to and exteriorly of said forms.

2. A concrete form assembly according to claim 1 in which the rod is of glass fibers.

3. A concrete form assembly according to claim 1 in which said rod is parallel to said spacers.

4. A concrete form assembly according to claim 1 in which a tie rod is within a spacer.

5. A concrete fitting according to claim 1 in which each shell has a flange at the larger end thereof for retaining the components of the anchor within the shell.

* * * * *